US005934390A

United States Patent [19]

Uthe

[11] Patent Number: 5,934,390

[45] Date of Patent: Aug. 10, 1999

[54] HORIZONTAL DRILLING FOR OIL RECOVERY

[76] Inventor: Michael Uthe, 1730 Plymouth Rd. Suite 101, Minnetonka, Minn. 55340

[21] Appl. No.: 08/997,401

[22] Filed: Dec. 23, 1997

[51] Int. Cl.[6] ..... E21B 7/18

[52] U.S. Cl. ..... 175/67; 175/62

[58] Field of Search ..... 175/78, 62, 77, 175/67; 166/298, 55, 223

[56] References Cited

U.S. PATENT DOCUMENTS

| | | | |
|---|---|---|---|
| 2,783,972 | 3/1957 | Fehlmann | 175/424 |
| 4,018,623 | 4/1977 | Walker . | |
| 4,022,279 | 5/1977 | Driver | 166/271 |
| 4,265,487 | 5/1981 | Barker . | |
| 4,527,639 | 7/1985 | Dickinson, III et al. | 175/61 |
| 4,793,740 | 12/1988 | Schellhorn . | |
| 4,973,026 | 11/1990 | Saurwein . | |
| 5,197,783 | 3/1993 | Theimer et al. | 299/17 |
| 5,255,750 | 10/1993 | Wilkes, Jr. et al. | 175/61 |
| 5,540,292 | 7/1996 | Behrens . | |
| 5,553,680 | 9/1996 | Hathaway . | |

OTHER PUBLICATIONS

Brochure of Jet Edge, "Ultra–High Pressure Waterjet Systems", believed to be available more than one year prior to the filing date of the instant application.

*Primary Examiner*—Tamara Graysay
*Assistant Examiner*—Sunil Singh
*Attorney, Agent, or Firm*—Fredrikson & Byron, PA

[57] ABSTRACT

A method of drilling in a stratum and a method of enhancing recovery of a hydrocarbon material from an existing well. The method of drilling generally includes providing a drilling apparatus having at least one laterally oriented nozzle. Part of the drilling apparatus is moved downwardly along an existing bore without drilling until the nozzle is in position and pressurized hydraulic fluid is delivered through the nozzle to define a first generally horizontally oriented secondary bore. The nozzle is reoriented the nozzle is used to bore a second generally horizontal oriented secondary bore. The method of enhancing recovery may employ a similar process to define a first generally horizontally oriented secondary bore. The drilling apparatus is removed and pressurized hydraulic fluid is delivered into the main bore and the secondary bore to fracture the stratum to assist in extracting the hydrocarbon material from the well.

15 Claims, 3 Drawing Sheets

HORIZONTAL DRILLING FOR OIL RECOVERY

FIELD OF THE INVENTION

The present invention provides an improved means and method for drilling at an angle to the axis of an existing bore hole. The invention is particularly useful in drilling bore holes extending generally laterally outwardly from a vertical bore hole, as may be desirable in extracting oil from oil wells or contaminants from soil or groundwater.

BACKGROUND OF THE INVENTION

Wells are used to recover a variety of substances from the ground. Typically, wells are merely vertical bore holes extending from ground level to the desired depth. Some means of extracting the desired material (typically a fluid) is then attached to or inserted into the well and used to draw the material out of the bore hole.

In many circumstances, the well is designed to extract a specific material which resides at a specific depth or narrow range of depths below the surface. For example, in extracting crude oil, the vertical bore hole will typically pass through an oil-bearing layer for a depth of about 6 to about 60 feet (about 2–18 meters). This range of depths from which oil can be most readily extracted is commonly referred to as the "pay zone". In extracting environmental contaminants, such as hydrocarbons released in a ground-level spill which have seeped into the ground, there tends to be a much shorter pay zone, with depths of 1–2 feet (30–60 cm) being fairly common.

Vertical bore holes may not always be the most optimal structures for recovering some materials, though. Underground oil-bearing formations can be discontinuous and can vary significantly in depth even within a given field. An idealized oil field structure, showing varying underground strata and oil-bearing formations O, is schematically illustrated in FIG. 1. As a result of the underground structure, sinking a single vertical bore hole requires some degree of luck in hitting a suitable oil-bearing formation. In the scenario illustrated in FIG. 1, the vertical bore hole V is located within a large oil field, but this bore hole misses the oil-bearing formations underlying the site.

To increase the likelihood of intersecting an oil-bearing formation, more complex bore holes have been drilled with a significant portion of the length of the bore hole extending generally horizontally. Such bore holes usually are formed using fairly conventional drill bits attached to a flexible, steerable shaft. In drilling these holes, a vertical bore hole is drilled. When the vertical hole is a predetermined distance (usually a number of feet) from the desired depth of the horizontal portion of the bore hole, a relatively viscous "mud" is urged out of a port located in a side of the housing of the drill bit. The pressure of this mud will urge the drill bit to the side, pushing it away from its vertical path. In this manner, the path of the drill bit can be curved so that it approaches a horizontal orientation. Once the drill bit is horizontally oriented, the goal is to maintain that orientation and extend the bore hole substantially horizontally.

Unfortunately, the control over such a "horizontal" drilling operation is not as precise as one might wish. For a given lateral fluid pressure exiting one of the side ports near the drill bit, the degree of curvature induced in the path of the drill bit will vary depending on the properties of the adjacent ground structure. As a result, it can be difficult to accurately determine the depth at which the drill bit will first reach a horizontal orientation. If the pay zone P is fairly large, that will leave sufficient leeway to accommodate such variances. Such variances can make this approach much less attractive if the pay zone is significantly smaller, e.g., in the case of recovery of groundwater contaminants, because of the difficulties in targeting such a specific depth.

Even if the correct horizontal level is initially achieved, though, it can be difficult to maintain. When attempting to drill horizontally with such a drill bit, underground formations of differing hardness will tend to deflect the bit from a horizontal path. As suggested in FIG. 1, the strata underground often are not horizontal. If a bit encounters an interface between a hard layer and a relatively soft layer, the drill bit will tend to follow that interface rather than continue on a horizontal path through the harder material. As a result of all of these difficulties, the path followed by the drill bit tends to deviate rather significantly from horizontal and may wander in and out of the targeted pay zone, as suggested by the path of the bore hole H in FIG. 1.

To counter these difficulties, horizontal drilling tends to be a rather complex, carefully controlled operation. The shaft must include several circumferentially spaced holes through which the pressurized "mud" can be forced to steer the bit in three dimensions. Expensive systems are used to track the position of the drill bit underground on a real-time basis. An experienced operator or a highly sophisticated computer controller must carefully adjust the pressure of the mud delivered through each hole in reaction to each deviation from the intended path. As a consequence, drilling horizontally tends to be exceedingly expensive.

If one has already defined a bore hole, any drill bit inserted into that same bore hole will tend to follow the same bore hole rather than deviate from the previously-cleared path. As a consequence, it can be problematic to try to drill a second horizontal bore hole from within a vertical bore hole created for a previous horizontal drilling operation. As a consequence, if one wants to try multiple horizontal paths across a single field, one usually has to sink a separate vertical bore hole for each and every horizontal path. This significantly increases costs, particularly for deeper pay zones.

Some wells may yield only a small volume of the desired material, limiting the commercial feasibility of the well. For example, some oil wells which initially produced substantial amounts of oil will having decreasing yields over time until only small amounts of oil can be extracted. It may even be necessary to use pumping aids, such as a so-called "horse-head" pump, to help pull the oil from the underground formation.

To increase the yield from such wells, it may be possible to fracture the surrounding rock and ease the flow of the desired material to the bore hole. In oil wells, this is most commonly done by injecting a highly pressurized fluid (e.g., water, oil or a gas) into the bore hole. It can be difficult to accurately direct this pressure and fracture the surrounding structure primarily in the pay zone, though, and the force tends to be dissipated non-beneficially in structure outside the pay zone.

SUMMARY OF THE INVENTION

The present invention contemplates both a drilling method and a drilling apparatus. One embodiment of the method can be used widely in a variety of circumstances where it may be desirable to drill in a direction deviating from the orientation of an existing bore hole. Another embodiment of the method is particularly well suited for enhancing recovery of a hydrocarbon material from an existing well, such as by increasing yield from an oil-well. One embodiment of an apparatus of the invention provides a drilling apparatus for drilling bores extending laterally from an existing primary bore.

In a first embodiment of a method of drilling, a drilling apparatus is provided, the apparatus having an elongate base; a mount carried adjacent the distal end of the base and including at least one laterally oriented nozzle having an axis which extends generally laterally outwardly of the tubular base; and a hydraulic delivery line operatively connecting the nozzle to a fluid source. A primary bore hole which extends generally vertically downwardly through is located. The apparatus is moved downwardly along the primary bore hole without drilling until the nozzle is positioned at a predetermined vertical depth within the stratum. A pressurized hydraulic fluid is delivered through the hydraulic delivery line and directed with the nozzle to impact against the stratum with sufficient force to bore through the stratum to define a first generally horizontally oriented secondary bore forming a predefined angle with respect to the primary bore.

In one embodiment of the invention well suited for enhancing hydrocarbon recovery, a drilling apparatus substantially as outlined above is provided. The drilling apparatus is moved downwardly along the primary bore hole without drilling until the nozzle is positioned within a predetermined pay zone wherein the hydrocarbon is believed to be located. A pressurized hydraulic fluid is delivered through the hydraulic delivery line and directed with the nozzle to impact against the stratum with sufficient force to bore through the stratum to define a first generally horizontally oriented secondary bore forming a predefined angle with respect to the primary bore. The hydrocarbon material can be extracted from the well, typically at an increased rate.

One embodiment of a drilling apparatus of the invention is useful for drilling bores extending laterally from an existing primary bore in a stratum. This apparatus may generally include an elongate tubular base extending along the primary bore; a mount and a hydraulic delivery line. The mount desirably is carried adjacent a distal end of the base and includes at least one laterally oriented nozzle having an axis which extends outwardly of the base. The hydraulic delivery line operatively connects the nozzle to a fluid source, delivering pressurized fluid from the fluid source to the nozzle under sufficient pressure to permit the hydraulic fluid to cut through the stratum surrounding the primary bore to define a secondary bore extending laterally of the primary bore.

DETAILED DESCRIPTION OF THE PREFERRED EMBODIMENTS

Figure 1:
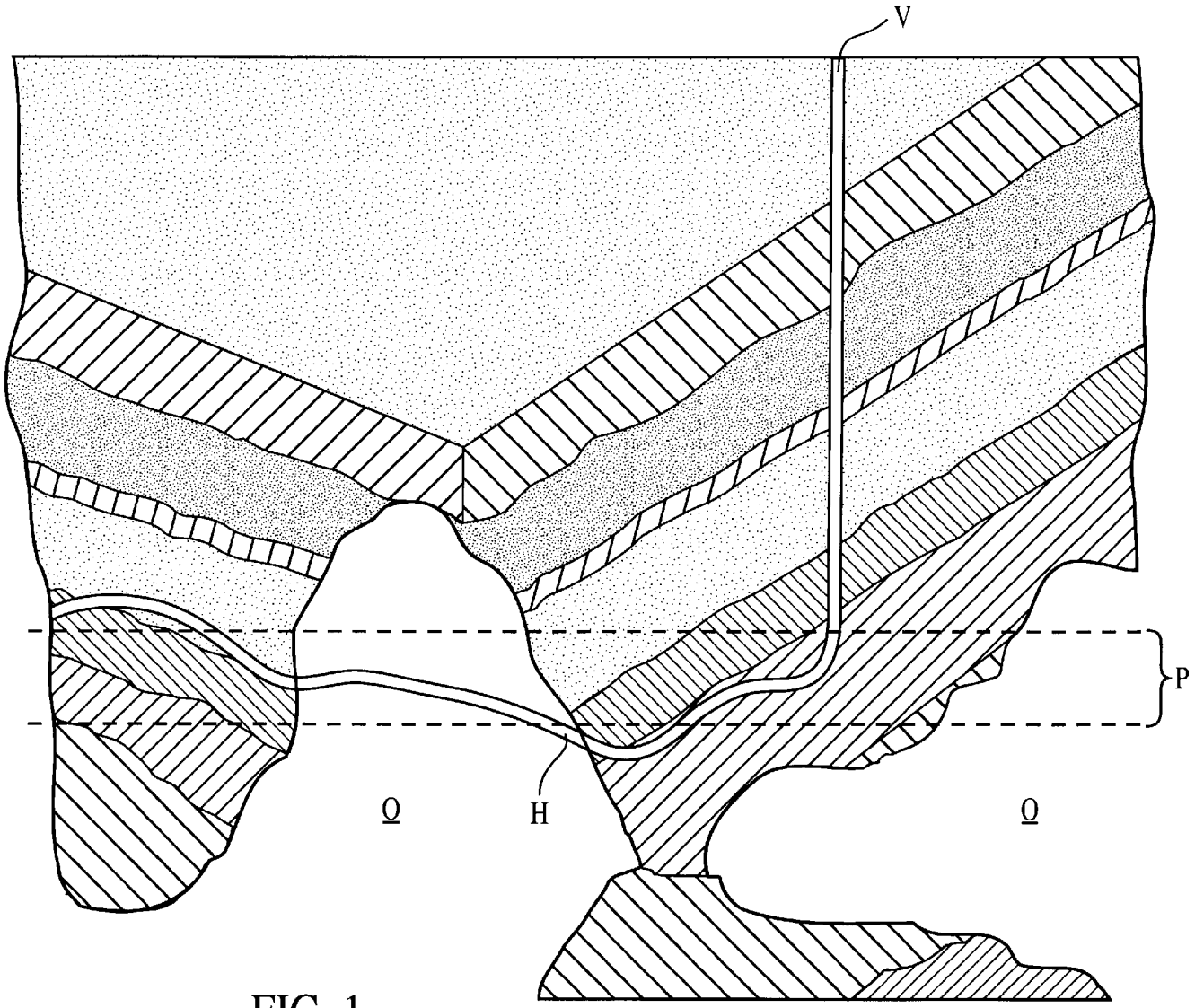
FIG. 1 is a schematic cross sectional view of an underground formation illustrating conventional drilling techniques in a stylized oil field.
Figure 2:
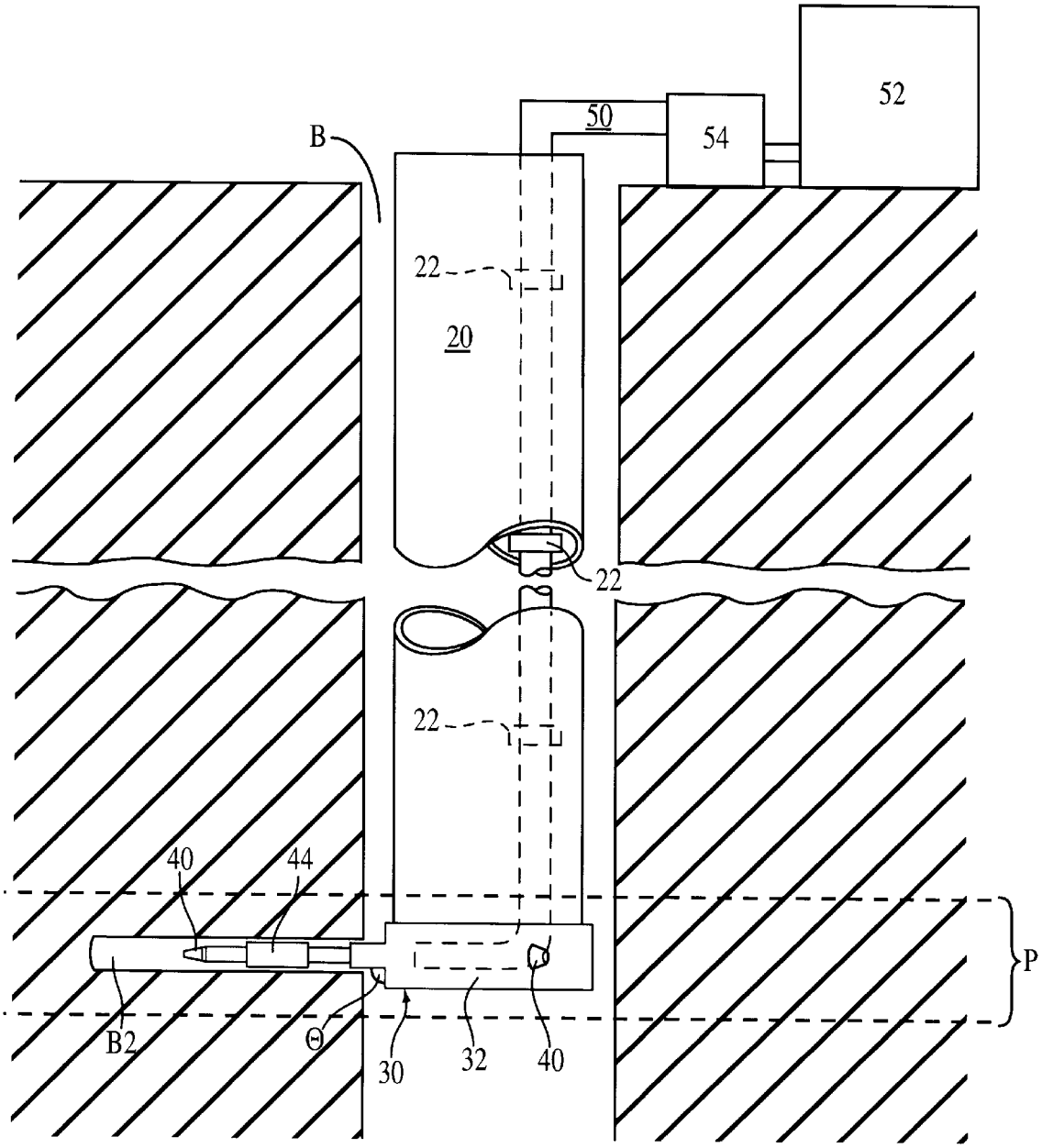
FIG. 2 is a schematic illustration of a drilling apparatus in accordance with the invention.

FIG. 2 schematically illustrates one embodiment of an apparatus of the invention. In this embodiment, the drilling apparatus 10 generally includes an elongate tubular base 20, a mount 30 and a hydraulic delivery line 50. The tubular base can be of any desired structure which will permit it to support the mount 30 and hydraulic delivery line 50 in the desired position. In FIG. 2, it is schematically depicted as a hollow tube extending from a position above ground to a distal end positioned adjacent a targeted "pay zone" P in the ground. Instead of being hollow, however, the tubular base could instead comprise a solid shaft, such as a solid stainless steel pole of the desired length. Particularly if there is no intention to withdraw any fluids from the well with the drilling apparatus in the bore hole, such a solid base may actually be preferable to the hollow base illustrated.

Preferably, the base 20 is also adapted to support the weight of the hydraulic delivery line 50. As detailed below, this line 50 delivers fluid to a nozzle 40 on the mount 30. It may well be possible to put the entire fluid supply system within the well. However, in many circumstances it may be necessary to deliver fluid from a fluid reservoir 52 positioned above ground, as shown. In such a situation, the base 20 should be designed to support the delivery line 50, such as by providing a plurality of spaced-apart clamps 22 on the base which are designed to hold the delivery line in place.

The mount 30 is carried adjacent the distal end of the base 20. The mount may be very simple in structure, comprising nothing more than a distal length of the base 20. In the illustrated embodiment, the mount comprises a generally annular ring 32 which is attached to the distal end of the base. This ring can be simply bolted, welded or otherwise rigidly attached to the base.

If so desired, though, the ring 32 can be rotatably attached to the base so it can turn about an axis shared with the base. As discussed below, this would enable the mount 30 to pivot with respect to the base to reorient the nozzle 40 to form another bore hole. If the ring 32 were designed to rotate, it may be desirable to include some sort of motor (e.g., an electric motor or a hydraulically activated motor, not shown) to move the mount with respect to the base.

The mount carries at least one nozzle 40 which is oriented laterally with respect to the axis of the base 20. The nozzle should be adapted to deliver a high pressure stream of hydraulic fluid so it may cut the underground structure. Such fluid-delivery nozzles are well known in the art, being commonly referred to as "water jet cutting" nozzles as water is the fluid most commonly used for cutting.

Such nozzles are well known in the art and need not be discussed in detail here. For example, one such nozzle is disclosed in U.S. Pat. No. 4,973,026, the teachings of which are incorporated herein by reference. Water jet cutting systems employing such nozzles are commercially available from a number of sources, including Jet Edge, a division of TC/American Monorail, Inc., in Minneapolis, Minn., USA. If so desired, the nozzle may be a so-called cavitating nozzle, which delivers a tubular stream of fluid, to improve effectiveness of the boring operation; such cavitating nozzles are known in the art.

The nozzle should be oriented at an angle $\theta$ with respect to the axis of the base. In the illustrated embodiment, this angle is about 90°, permitting the nozzle to bore a hole oriented at a right angle with respect to the axis of the base and, if the base is generally aligned with or parallel to the axis of the primary bore in which it is positioned, at a right angle with respect to the axis of the primary bore itself. These axes need not be perpendicular, though. Preferably, though the angle is between about 45° and about 90°, with an angle of about 70° to about 90° being preferred. It should also be understood that the axis of the nozzle 40 need not actually intersect the axis of the base 20. For example, the nozzle could be oriented with its axis extending generally tangential to the base. The axis of the nozzle should lie in a plane which defines an angle (roughly 90°-θ) of between about 0° and about 45° (with an angle of about 0° to about 20° being preferred) with respect to a plane orthogonal to the axis of the base.

The nozzle 40 can be rigidly connected to the mount 30. As noted below, even through fairly hard materials, it may be possible to drill through 4 feet (about 120 cm) or more of rather hard material without having to move the nozzle. For many applications where longer bore holes are needed, though, the nozzle can be carried on the end of a telescoping extension 44 extending outwardly from the mount 30 generally in line with the axis of the nozzle. Such an extension may comprise a series of slotted stainless steel tubes or the like of varying diameters, with the smaller tube(s) being received in the lumen of the larger tube(s). This extension 44 can telescope to different lengths to advance the nozzle within the bore hole the nozzle itself forms. By so advancing the nozzle, the length of the secondary bore formed by the nozzle can be extended. U.S. Pat. No. 5,553,680 (issued to Hathaway, the teachings of which are incorporated herein by reference) shows a so-called "mole" which can be used to alternately advance and stabilize a standard cutting bit in a horizontal bore. It is believed such a system could be used in connection with the present invention by mounting the nozzle 40 on the mole and using the mole to advance the nozzle along the bore hole instead of employing a telescoping extension 44 such as that shown in the drawings.

To further improve the effectiveness of the nozzle, the mount or an extension on which the nozzle is carried can be designed to oscillate during operation. This will move the focus of the cutting jet to make a bore larger than the perimeter of the jet itself. It is believed that this will permit water to exit the bore as it is being formed, limiting the back pressure from water draining from the bore against the flow of water exiting the nozzle. Oscillating the nozzle in this manner is also known in the art of water jet cutting.

It is to be understood that the mount 30 may carry more than one nozzle. As shown in FIG. 2, for example, the mount 30 can carry two or more nozzles 40. In the illustrated embodiment, both of the nozzles are at about the same height, with the nozzles being spaced about the circumference of the generally annular mount. Other embodiments can be equally useful, though. For example, the nozzles can be spaced vertically from one another and there may even be two or more sets of nozzles, with each nozzle in a set lying at the same depth, but different sets being positioned at different heights.

Providing a plurality of nozzles 40, one can define a preselected boring pattern, allowing one to bore a plurality of holes having a known relationship to one another without having to rotate the mount 30 with respect to the bore B. In one embodiment, all of the nozzles are supplied with a single hydraulic delivery line 50, with the line connecting to each of the nozzles either in parallel or in series. This will permit a plurality of bores to be created in a single operation.

If so desired, though, each nozzle can be connected to a different hydraulic delivery line. As a matter of fact, different nozzles could even be connected to different fluid supplies to achieve different treatments. For example, if two nozzles are provided, one can be adapted to do the primary boring and be connected to a high-pressure fluid supply while the other nozzle can be provided with an acidic solution. One could first bore a hole with the first nozzle and then inject acid with the second nozzle into the newly created bore hole. As explained below, such an acid treatment can increase yield from the bore and, as an added benefit, the acid solution can also help physically wash out of the bore any abrasive grit entrained in the hydraulic fluid delivered by the first nozzle.

Water jet cutting systems typically operate at rather high pressures, e.g. about 30,000–75,000 psi (about 2,000–5,300 kg/cm$^2$). The hydraulic delivery line 50 should be adapted to ensure a reliable supply of cutting fluid to the nozzle maintained at a suitable pressure. It is currently contemplated that the delivery line 50 may comprise a flexible metal tubing capable of withstanding such pressures extending from an above-ground fluid reservoir 52 to the nozzle 40. It is also currently contemplated that a high pressure pump 54 or the like will be positioned above ground to generate sufficient pressures. If it is determined that this is not feasible, e.g. pressure losses may be too large if the pump is too far from the nozzle in a deeper well, the pressure may be either stepped up or generated completely by one or more pumps positioned within the bore hole.

The cutting fluid may be simple water. This can be supplied from an above-ground fluid reservoir 52 or, presumably, one could use water obtained from the well itself if the region of interest were close enough to the water table. To further increase cutting efficiency, though, the fluid delivered through the nozzle may include an abrasive grit entrained therein. As is known in the field of water jet cutting, a slurry of water and a hard grit, such as feldspar or garnet particles, can cut through a greater thickness of the same material than can water alone. As a matter of fact, at higher operating pressures, it has been found that water with garnet particles entrained therein can bore a substantially straight hole through as much as 45–50 inches (about 115–125 cm) of cement. It is also known in the water jet cutting art to add other components to the cutting fluid to achieve other properties, such as by adding a polymeric component to the water or instead of the water to maintain stream continuity or increase the possible operating pressures.

The present techniques can be used for a variety of purposes, including directly enhancing the productivity of an existing well or preparing a well for fracturing. In a first embodiment of the invention, a drilling apparatus is provided. This drilling apparatus should be capable of boring a hole extending laterally from a primary bore at a desired angle, but the details of the drilling apparatus can vary without departing from the present method. While the drilling apparatus 10 described above and shown in FIG. 2 would suffice, a variety of substitutions, variations and omissions can be made in the apparatus yet still be able to practice the method of the invention. For purposes of simplicity, the following explanation will discuss the method using the drilling apparatus 10 shown in FIG. 2, but it should be understood that this example is not limiting.

In accordance with a method of the invention, the drilling apparatus 10 is used to drill one or more secondary bores extending laterally of a primary bore. In one embodiment, this method can be with an existing primary bore which extends generally vertically downwardly through at least a portion of the stratum of interest. This primary bore can be part of an existing production well, with the present method being used to increase production from that pre-existing well. Alternatively, one could drill the primary bore hole and form the secondary bore holes in that existing bore hole essentially immediately thereafter.

Once the primary bore hole is located, at least a portion of the drilling apparatus can be moved downwardly along the primary bore hole without drilling. (This is different from many other drilling techniques, which form the entire final bore in one drilling operation.) If using the drilling apparatus 10 of FIG. 2, the mount 30 can be lowered into the primary bore hole by means of the base 20. The mount 30 is moved down within the bore hole until the nozzle 40 is positioned at a predetermined vertical depth within the targeted stratum. For example, the operator may know the depth at which the pay zone of interest resides and the mount can be lowered until the nozzle is at the same depth as the pay zone.

One the nozzle 40 is properly positioned, pressurized hydraulic fluid can be delivered through the hydraulic delivery line to the nozzle. The nozzle can be used to direct the hydraulic fluid to impact against the stratum with sufficient force to bore through the stratum. In this manner, one can define a generally horizontally oriented secondary bore forming a predefined angle with respect to the primary bore. In most circumstances, the axis of the base 20 used to position the nozzle 40 will be generally aligned with, or at least generally parallel to, the axis of the bore hole. As a consequence, the angle of the nozzle 40 with respect to the axis of the base will determine the angle of the secondary bore with respect to the primary bore.

The secondary bore formed in accordance with the invention will provide a number of advantages. The yield of oil or other desired material from a well is often increased by increasing the surface area of the pay zone exposed to the well. The use of the nozzle 40 and pressurized hydraulic fluid allows the secondary bore B2 to be fairly precisely positioned, ensuring that the secondary bore will extend into the pay zone P for a significant distance, as suggested in FIG. 3. Accordingly, the secondary bore significantly increases the exposed surface area of the pay zone, enhancing yield when the hydrocarbon (e.g., oil or an environmental contaminant) or other material is extracted.

Figure 3:
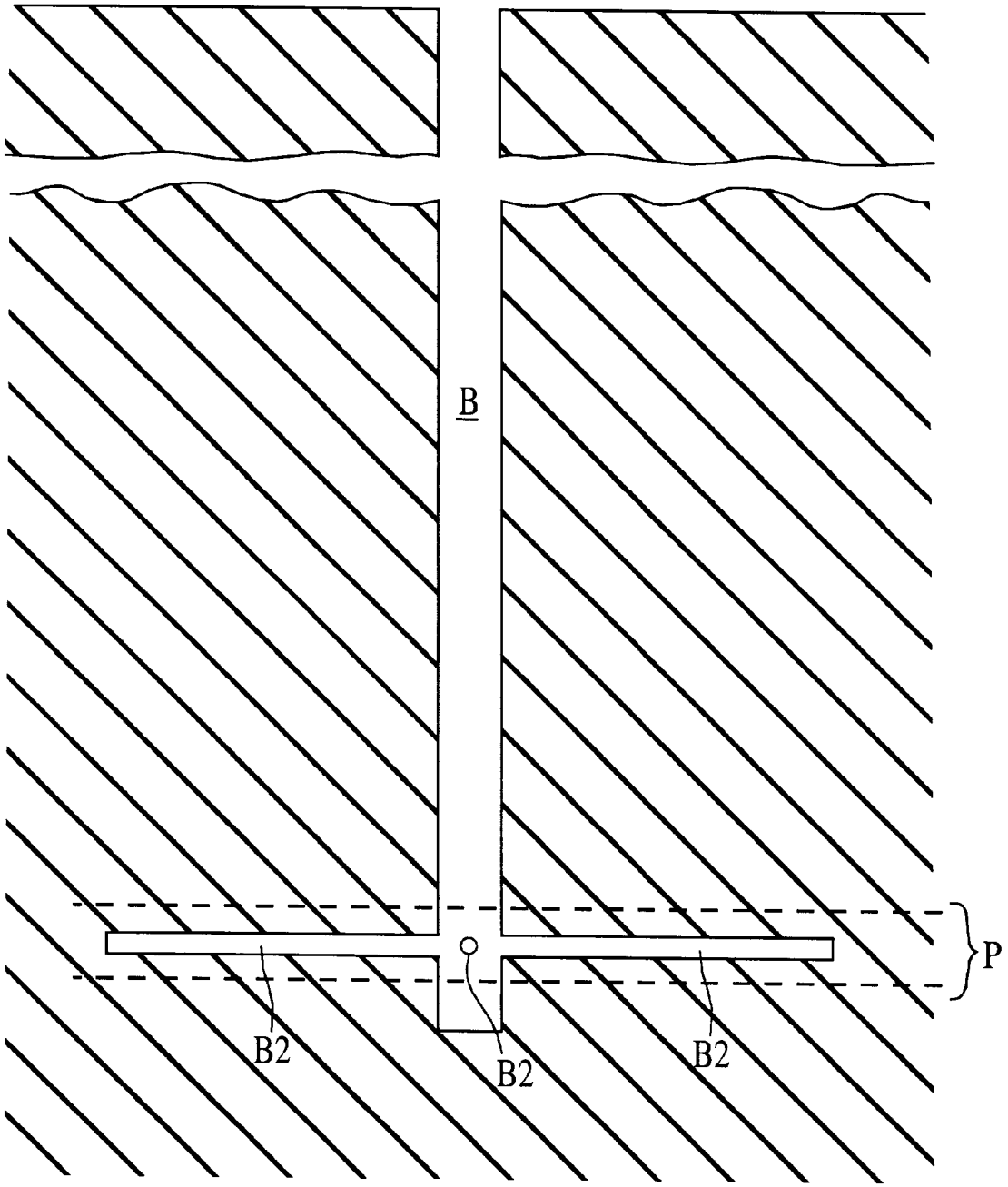
FIG. 3 is a schematic illustration of a vertical primary bore hole with a plurality of generally horizontal secondary bore holes extending laterally outwardly therefrom.

This benefit can be further enhanced by drilling additional secondary bores (also B2 in FIG. 3). This can be accomplished by reorienting the nozzle 40 in a different direction and delivering pressurized hydraulic fluid through the hydraulic delivery line and directing the hydraulic fluid with the nozzle to impact against the stratum with sufficient force to bore through the stratum to define a second generally horizontally oriented secondary bore. The manner in which the nozzle 40 is reoriented will vary depending on the structure of the drilling apparatus. If the mount 30 comprises an annular ring which is rotatable with respect to the base 20, the mount can simply be rotated and the second secondary bore B2 can be formed.

Typically, the angle of the plane in which the nozzle lies with respect to a plane orthogonal to the axis of the primary bore will not change. Additionally, if the first secondary bore B2 is properly positioned, the other secondary bore will be formed at the same depth. Accordingly, the first and second secondary bores will be oriented at the same angle with respect to the primary bore and will be located at about the same depth within the primary bore.

This process can be repeated as many times as desired. Each of the secondary bores extends laterally from the primary bore. With multiple secondary bores B2, the resulting structure can resemble the spokes of a wheel, with the primary bore B in the position of the hub.

The surface area of these secondary bores can be further enhanced to further increase yield. For example it is known in the art to use acids to etch the underground formation in the pay zone. Since the structure is rarely formed of a homogenous material, some components will preferentially dissolve, leaving a crenellated or porous structure with greater surface area.

The secondary bore(s) B2 can also be used in conjunction with fracturing the bore in a conventional manner. As noted above, it is known to inject a high-pressure fluid into the bore hole of a well to fracture the underground structure in which the material to be extracted resides. This makes it easier for the fluid to flow into the well for extraction. Unfortunately, it is rather difficult to confine the force of the pressurized fluid to the area of interest, such as a suspected pay zone for the material.

The secondary bore(s) B2 formed in accordance with the invention help direct the pressurized fluid into the pay zone. Particularly if a plurality of secondary bores B2 are formed at the same depth, it is believed that the secondary bores can help define a preferred direction for the fracturing of the stratum of the pay zone, effectively enhancing the effectiveness of the pressurized fluid by directing more of the fracturing force into the pay zone.

The drilling apparatus 10 of the invention can also be used in an alternative method, either along or in conjunction with the method outlined above. Many bore holes are lined with a rigid casing formed, e.g. of steel. In this alternative method, the nozzle is used to cut the casing of an existing bore hole. If so desired, the nozzle can be used just to cut a hole or slot in the casing, perhaps keeping the nozzle stationary or oscillating it somewhat as described above.

Use of the nozzle need not be limited to such a focused cutting, though. Instead, by moving the nozzle over a larger distance, one can cut away larger sections of the casing to make larger holes. By rotating the mount 30 about an axis of the base 20 (either by turning the base or by turning the mount with respect to the base), one could cut through the casing to separate it into lengths. By cutting the casing to appropriate lengths in this fashion, it may be possible to then pull the casing out of the bore hole to salvage the casing from a spent bore hole.

While a preferred embodiment of the present invention has been described, it should be understood that various changes, adaptations and modifications may be made therein without departing from the spirit of the invention and the scope of the appended claims.

What is claimed is:

1. A method of drilling in a stratum, comprising a) providing a drilling apparatus having an elongate base; a mount carried adjacent a distal end of the base and including at least one laterally oriented nozzle having an axis which extends generally laterally outwardly of the base; and a hydraulic delivery line operatively connecting the nozzle to a fluid source;

b) locating an existing primary bore which extends generally vertically downwardly through at least a portion of the stratum;

c) moving at least the mount of the drilling apparatus downwardly along the primary bore without drilling until the nozzle is positioned at a predetermined vertical depth within the stratum;

d) delivering pressurized hydraulic fluid through the hydraulic delivery line and directing the hydraulic fluid with the nozzle to impact against the stratum with sufficient force to bore through the stratum to define a first generally horizontally oriented secondary bore forming a predefined angle with respect to the primary bore; and e) reorienting the nozzle in a different direction and delivering pressurized hydraulic fluid through the hydraulic delivery line and directing the hydraulic fluid with the nozzle to impact against the stratum with sufficient force to bore through the stratum to define a second generally horizontally oriented secondary bore.

2. The method of claim 1 wherein the first and second secondary bores are oriented at the same angle with respect to the primary bore.

3. The method of claim 1 wherein the first and second secondary bores are located at about the same depth within the primary bore.

4. The method of claim 1 further comprising the steps of a) removing the mount of the drilling apparatus from the primary bore; and b) delivering pressurized hydraulic fluid into the primary bore and the secondary bores to fracture the stratum.

5. The method of claim 1 wherein the predetermined vertical depth is selected to correspond to a pay zone within the stratum, the method further comprising extracting a hydrocarbon material from the stratum.

6. The method of claim 5 wherein the hydrocarbon material being extracted is oil.

7. The method of claim 5 wherein the hydrocarbon material being extracted comprises an environmental contaminant.

8. A method of enhancing recovery of a hydrocarbon material from an existing well having a primary bore, comprising:

a) providing a drilling apparatus having an elongate base; a mount carried adjacent a distal end of the base and including at least one laterally oriented nozzle having an axis which extends generally laterally outwardly of the base; and a hydraulic delivery line operatively connecting the nozzle to a fluid source;

b) moving at least the mount of the drilling apparatus downwardly along the primary bore without drilling until the nozzle is positioned within a predetermined pay zone wherein the hydrocarbon is believed to be located;

c) delivering pressurized hydraulic fluid through the hydraulic delivery line and directing the hydraulic fluid with the nozzle to impact against the stratum with sufficient force to bore through the stratum to define a first generally horizontally oriented secondary bore forming a predefined angle with respect to the primary bore;

d) extracting the hydrocarbon material from the well;

e) removing the drilling apparatus from the primary bore; and f) delivering pressurized hydraulic fluid into the primary bore and the secondary bore to fracture the stratum.

9. The method of claim 8 further comprising the steps of reorienting the nozzle in a different direction and delivering pressurized hydraulic fluid through the hydraulic delivery line and directing the hydraulic fluid with the nozzle to impact against the stratum with sufficient force to bore through the stratum to define a second generally horizontally oriented secondary bore.

10. A method of drilling in a stratum, comprising:

a) providing a drilling apparatus having an elongate base and at least one laterally oriented nozzle having an axis which extends generally laterally outwardly of the base;

b) locating an existing primary bore which extends generally vertically downwardly through at least a portion of the stratum;

c) moving at least the nozzle of the drilling apparatus downwardly along the primary bore without drilling until the nozzle is positioned at a predetermined vertical depth within the stratum;

d) directing pressurized hydraulic fluid with the nozzle to impact against the stratum with sufficient force to bore through the stratum to define a first generally horizontally oriented secondary bore forming a predefined angle with respect to the primary bore; and e) reorienting the nozzle in a different direction and directing pressurized hydraulic fluid with the nozzle to impact against the stratum with sufficient force to bore through the stratum to define a second generally horizontally oriented secondary bore.

11. The method of claim 10 wherein the first and second secondary bores are oriented at the same angle with respect to the primary bore.

12. The method of claim 10 wherein the first and second secondary bores are located at about the same depth within the primary bore.

13. The method of claim 10 further comprising the steps of a) removing the mount of the drilling apparatus from the primary bore; and b) delivering a pressurized hydraulic fluid into the primary bore and the secondary bores to fracture the stratum.

14. A method of enhancing recovery of a hydrocarbon material from an existing well having a primary bore, comprising:

a) providing a drilling apparatus having an elongate base and at least one laterally oriented nozzle having an axis which extends generally laterally outwardly of the base;

b) moving at least the nozzle of the drilling apparatus downwardly along the primary bore without drilling until the nozzle is positioned within a predetermined pay zone wherein the hydrocarbon is believed to be located;

c) directing pressurized hydraulic fluid with the nozzle to impact against the stratum with sufficient force to bore through the stratum to define a first generally horizontally oriented secondary bore forming a predefined angle with respect to the primary bore;

d) extracting the hydrocarbon material from the well;

e) removing the drilling apparatus from the primary bore; and f) delivering pressurized hydraulic fluid into the primary bore and the secondary bore to fracture the stratum.

15. The method of claim 14 further comprising the steps of reorienting the nozzle in a directing pressurized hydraulic fluid with the nozzle to impact against the stratum with sufficient force to bore through the stratum to define a second generally horizontally oriented secondary bore.

* * * * *